United States Patent [19]

Schlage

[11] 4,107,966

[45] Aug. 22, 1978

[54] SELECTIVELY ROTATABLE CYLINDER FOR A LOCK

[75] Inventor: Ernest L. Schlage, Burlingame, Calif.

[73] Assignee: Schlage Lock Company, San Francisco, Calif.

[21] Appl. No.: 786,010

[22] Filed: Apr. 8, 1977

[51] Int. Cl.[2] ..... E05B 9/04; E05B 27/04

[52] U.S. Cl. ..... 70/364 A; 70/375; 70/406

[58] Field of Search ..... 70/364 A, 375, 406, 70/419, 421

[56] References Cited

U.S. PATENT DOCUMENTS 1,685,022 9/1928 Cleaver ..... 70/364 A

*Primary Examiner*—Robert L. Wolfe

*Attorney, Agent, or Firm*—Lothrop & West

[57] ABSTRACT

A selectively rotatable cylinder for a lock has a cylinder housing with a bore extending along an axis. A cylinder plug having a keyway therein is rotatable in the bore about the axis. The plug is connected to a driving means for actuating any connected lock mechanism. In the cylinder body and cylinder plug are pin tumblers adapted to be positioned by a key in the keyway. An upper tumbler pin in the cylinder body is spring-pressed toward the keyway. A portion of the cylinder plug in the transverse plane of the upper tumbler pin is cut away to provide a substantially chordal cam surface or ramp extending from the periphery of the plug to a radially inward intersection with the keyway. The upper tumbler pin follows the ramp and moves toward the axis as the plug is turned by a key in the keyway. The side of the key encounters the lowered upper tumbler pin after a predetermined amount of rotation about the axis, thus preventing further rotation of the cylinder plug. A special key with a cut-out slot when located in the keyway and turned passes or clears the lowered tumbler pin and affords additional plug rotation about the axis.

2 Claims, 6 Drawing Figures

SELECTIVELY ROTATABLE CYLINDER FOR A LOCK

BRIEF SUMMARY OF THE INVENTION

In some locksets for securing the closed position of a door panel with respect to a door frame, there are two locking mechanisms; for example, a deadbolt and a latchbolt. Usually, both of these are readily actuated from the room side or inside of the lock mechanism but are only selectively operable from the exterior side or outside thereof. Customarily, one outside operator responds to a key and retracts both the deadbolt and the latchbolt from their projected or locked position. It is also usually arranged that another exterior operator, such as a handle or a lever, operates one of the bolts or sometimes both. To take care of various requirements, it is sometimes desired to afford one key effective to operate only one of the bolts and to provide another key effective to operate the other one or even both of the bolts. The attendant lock mechanism is usually complex and bulky and has various detrimental factors. The aim of this invention is to provide a simple arrangement in which one key is effective to operate one of the bolts and another key is effective to operate both of the bolts in an otherwise relatively standard environment and within a small compass.

DETAILED DESCRIPTION

Figure 1:
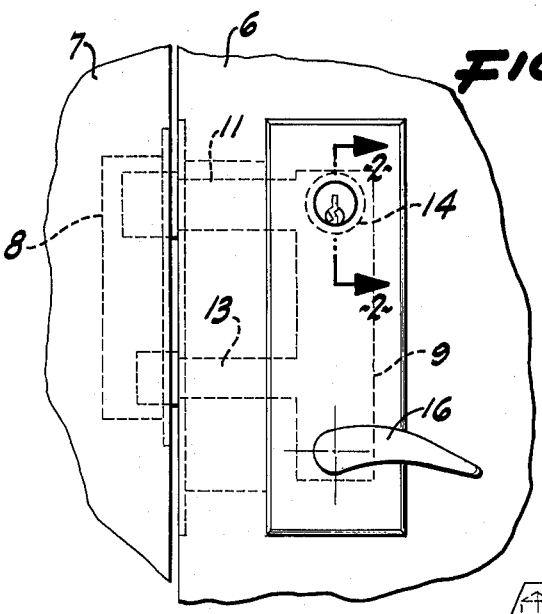
FIG. 1 is a side elevation of a lockset installed on a door panel and cooperating with a door frame and embodying the subject matter of the invention.

While the subject matter of the present invention can be embodied in a widely variant number of ways, it has with considerable success been embodied as shown herein. A representative installation is in a door panel 6 mounted on the customary hinges to swing toward and away from a door frame 7. In the door frame is an elongated strike box 8 and on the door panel is a lockset 9 including a deadbolt 11 reciprocable into and out of the strike box by lock mechanism well known and so not illustrated herein. Also reciprocable into and out of the strike box is a latchbolt 13 actuated by part of the same lockset mechanism 9.

The lockset can be worked by exterior controls. On one side of the panel is a key-actuated operator 14 and a hand-actuated operator 16. In this instance the operator 16 is a lever, although a knob or the like can be utilized. There are various well-known ways of interrelating the key operator 14 and the hand operator 16. In one arrangement, the key operator 14 when rotated first withdraws the latchbolt 13 fully and then, in sequence, withdraws the deadbolt 11 fully. The hand operator 16 when rotated simply withdraws the latchbolt 13 only. As an example, the key operator 14 in rotating through a part of a larger rotation; say, 90°, first retracts the latchbolt and then continues its rotation through, say, another 90°, to withdraw the deadbolt. There are several permutations of this sequence customarily made, all of which can be effected by the present arrangement.

Although the lockset in this instance is made and installed in a manner comparable to that of the usual mortise lock, the lock mechanism of whatever nature is actuated by a driver bar 21 of the cylindrical type. The driver bar is rotatable about an axis 22 throughout a sufficient total number of degrees to actuate both the deadbolt 11 and the latchbolt 13 by a lock mechanism including a cylinder housing 23. A concentric bore 24 extends through the housing. There is a cylinder plug 26 disposed in the cylinder housing for rotation about the axis 22. The plug is retained against axial translation by an enlarged flange 27 at one end and a removable, threaded, adjusting collar 28 at the other end.

The housing 23 in one portion has a fin or flag 29 upstanding therefrom and provided with a number of radial bores 30, or at least one such bore, in which upper tumbler pins 31, or at least one upper tumbler pin, are disposed for sliding movement and are positioned or urged toward the axis 22 under the influence of springs 32.

Figure 3:
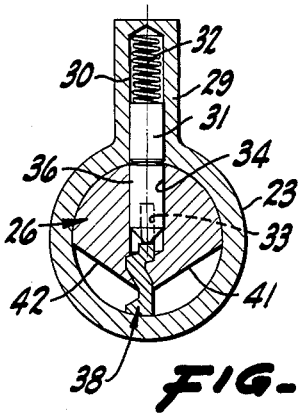
FIG. 3 is a cross-section, the plane of which is indicated by the line 3—3 of FIG. 2.
Figure 2:
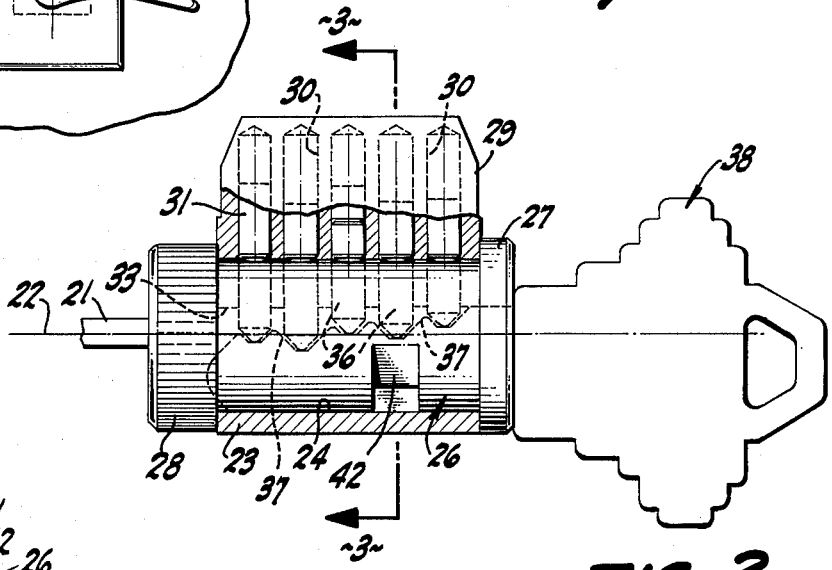
FIG. 2 is a cross-section to an enlarged scale, the plane of section being indicated by the line 2—2 of FIG. 1.

The plug 26 in the customary fashion is provided with a standard keyway 33 extending axially through the plug and open along the length of the plug to the interior surface of the cylinder body bore 24. Bores 34 in the plug 26, or at least one such bore, not only align with the bore or bores 30 in one rotary position of the plug, but likewise partially break through into the keyway 33. Within the bores 34 are lower tumbler pins 36. When all the pins are in rotary registry and unrestrained they are in axial misalignment. The lower tumbler pins meet with the upper tumbler pins to afford the customary shear line or surface when the lower tumbler pins interfit with the serrated edge 37 of a standard or normal key 38, as shown in FIGS. 2 and 3.

In the ordinary operation of this mechanism, the key 38 is introduced into the keyway until such time as the serrations 37 line up and position the various lower tumblers 36 relative to the upper tumblers 31 and relative to the housing structure. The key 38 can then be rotated without interference because none of the tumbler pins, either upper or lower, bridges the shear line. Rotation of the plug 26 by the key is effective through the driver bar 21 to actuate the mechanism of the lockset 9. The usual arrangement is that rotation of the driver bar 21 through an initial number of degrees; say, 90°, produces retraction of the latchbolt 13 only. The next 90°, for example, of rotation of the key and of the plug produces retraction of the deadbolt 11 also.

It is sometimes desired that the key 38 cannot be employed to do more than retract the latchbolt 13, for example, and has no power whatsoever to retract the deadbolt 11. This is the customary case when the occupant of the interior room guarded by the lock prefers to have sole control of the deadbolt and wants no one, not even a keyholder, to have access when the deadbolt has been projected by the interior control.

To accommodate that requirement, a special construction is employed. Ordinarily, the plug 26 is made circular-cylindrical throughout except for whatever interruption is afforded by the pin tumbler bores and the keyway. In this instance, however, the plug is especially contoured. As shown particularly in FIGS. 2, 3, 4 and 5, the plug, at any convenient location along its length and in the normal plane of any one of the tumbler pins, is specially shaped on one or both sides of the keyway. One or preferably a pair of inclined ramps 41 and 42 or planes or beveled surfaces are so arranged and disposed that they are approximately chordal in a crosssection of the plug normal to the axis 22. The ramps if continued would intersect each other substantially in the keyway radially inwardly or toward the axis from the plug surface. In other words, the ramps do not converge quite at the exterior surface of the plug, but stop at points 43 and 44 radially inwardly thereof and on opposite sides of the keyway. The ramps 41 and 42 are usually planar, although they can have curved or compound curved surfaces if desired.

Figure 6:
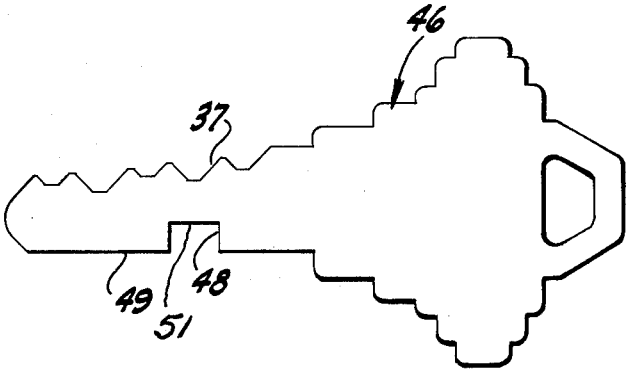
FIG. 6 is a side elevation of one form of key useful with the mechanism.

To cooperate with the ramps in a way different from that of the key 38, a special key 46, as shown in FIG. 6, is provided. This key is generally identical with the key 38 as to its serrations 37 and as to its length and other dimensions, but is characterized by a special portion conveniently in the shape of a rectangular notch 48 extending a substantial distance inwardly from the lower, unserrated edge 49 of the key.

The notch 48 and the cutaway or beveled ramp portions 41 and 42 of the plug are both of an axial dimension that is little more than the axial dimension of the adjacent one of the pin tumblers 31 and 36 in the plane of which the notch is symmetrically disposed.

Figure 4:
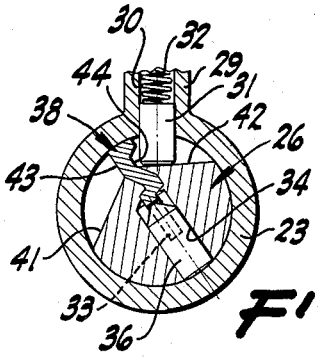
FIG. 4 is a cross-section similar to FIG. 3 but showing the parts in a different orientation, portions being broken away to reduce the figure size.
Figure 5:
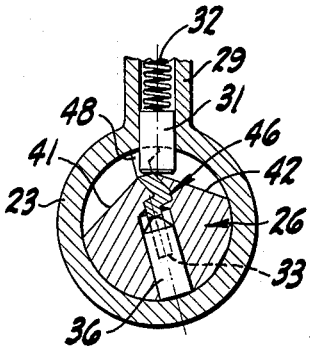
FIG. 5 is a view comparable to FIGS. 3 and 4 but with the parts in a different orientation.

In the operation of this arrangement, when the standard key 38 is utilized, as shown in FIGS. 2, 3 and 4, the key can be inserted as usual and can readily be rotated throughout a sufficient arcuate movement to cause retraction of the latchbolt 13, as an example. When the key 38 is rotated slightly past the point at which the latchbolt 13 is withdrawn, the side of the key comes into abutment or contact with the adjacent, lowered upper tumbler pin 31. Further plug rotation in the same direction is blocked or stopped. This results because as the plug is rotated from initial position the ramp 42 permits the spring 32 to move the upper tumbler pin 31 downwardly toward the axis 22 and to cam against or ride along the ramp into a lower position. The angle of approach of the key side surface to the upper tumbler pin is such that the lowered pin acts as a stop or barrier so the key cannot be given sufficient additional rotation to retract the projected deadbolt 11.

If the lock mechanism is of the opposite hand, then the other side of the key encounters the other side of the lowered upper tumbler pin 31 that has cammed against the other ramp 41. In this way a standard key 38 is effective to retract the latchbolt but not to disturb the deadbolt. This is acceptable for normal circumstances, but in an emergency there must be authorized access from the exterior even though the deadbolt 11 is thrown. The key 46, as shown in FIG. 6, with the notch 48 therein is provided for this purpose. When the key 38 is withdrawn and the key 46 is introduced into the keyway, the tumbler pins are oriented precisely as before and the key 46 operates to rotate the plug through the initial number of degrees just as before.

Also, just as before, either the ramp 41 or the ramp 42 permits the spring 32 to lower the upper tumbler pin 31 into its barrier position, as shown in FIG. 4. But in this instance, the notch 48 clears the lowered pin 31 and rotation of the plug continues with the lowered pin 31 riding from one ramp 42 to the other ramp 41, for instance, on the inner wall 51 of the notch. The further plug rotation accomplishes retraction of the deadbolt 11 and so permits emergency access from the exterior.

In sum, when the key 38 is used there is only limited access through the lock because only the latchbolt 13 can be retracted, but when the key 46 is utilized there is full access despite the barrier mechanism. Because of the notch 48 the key 46 can be fully rotated to withdraw both bolts.

I claim:

1. A selectively rotatable cylinder for a lock comprising a cylinder body having a bore therein extending along an axis, means defining an axially aligned series of upper tumbler bores spaced axially apart in said body and opening into said body bore, a series of upper tumbler pins having flat lower ends in said upper tumbler bores, springs urging said upper tumbler pins toward said body bore, a plug having a coaxial circular-cylindrical outer surface and disposed in said body bore and rotatable about said axis, means defining a keyway extending axially in said plug, means defining a series of lower tumbler bores in said plug opening into said keyway and in one rotary position of said plug disposed in radial alignment with respective ones of said upper tumbler bores, a series of lower tumbler pins in respective ones of said lower tumbler bores adapted to be engaged by a key in said keyway, and means defining a flat ramp on said plug extending chordally of said plug from an abrupt junction with said circular-cylindrical outer surface thereof toward a location in said keyway radially inward of said outer surface and in the normal plane of an intermediate one of said series of upper tumbler pins.

2. A device as in claim 1 including said key and in which said key has a notch of an axial length clearing only said intermediate one of said series of upper tumbler pins when said intermediate one of said upper tumbler pins is in contact with said ramp.

* * * * *